US011545072B2

(12) United States Patent
Liu et al.

(10) Patent No.: US 11,545,072 B2
(45) Date of Patent: Jan. 3, 2023

(54) DRIVING DEVICE OF DISPLAY PANEL AND DISPLAY DEVICE

(71) Applicants: HUIZHOU CHINA STAR OPTOELECTRONICS DISPLAY CO., LTD., Huizhou (CN); TCL CHINA STAR OPTOELECTRONICS TECHNOLOGY CO., LTD., Shenzhen (CN)

(72) Inventors: Jinfeng Liu, Huizhou (CN); Qingsheng Lan, Huizhou (CN)

( * ) Notice: Subject to any disclaimer, the term of this patent is extended or adjusted under 35 U.S.C. 154(b) by 0 days.

(21) Appl. No.: 17/600,152

(22) PCT Filed: Jun. 21, 2021

(86) PCT No.: PCT/CN2021/101210
§ 371 (c)(1),
(2) Date: Sep. 30, 2021

(65) Prior Publication Data

US 2022/0392391 A1 Dec. 8, 2022

(30) Foreign Application Priority Data

Jun. 8, 2021 (CN) ..... 202110634674.7

(51) Int. Cl.
*G09G 3/20* (2006.01)

(52) U.S. Cl.
CPC ... *G09G 3/2092* (2013.01); *G09G 2310/0278* (2013.01); *G09G 2310/08* (2013.01)

(58) Field of Classification Search
CPC ..... G09G 3/2092; G09G 2310/0278; G09G 2310/08
See application file for complete search history.

(56) References Cited

U.S. PATENT DOCUMENTS

| | | | | |
|---|---|---|---|---|
| 4,979,049 | A | 12/1990 | Chamzas | |
| 5,402,149 | A * | 3/1995 | Amagami | G09G 3/3611 345/55 |
| 6,130,660 | A | 10/2000 | Imsand | |
| 6,266,042 | B1 | 7/2001 | Aratani | |
| 6,331,862 | B1 * | 12/2001 | Yamada | G09G 5/005 348/913 |
| 6,448,976 | B1 | 9/2002 | Nitta et al. | |
| 10,248,198 | B1 * | 4/2019 | Kim | G06F 3/011 |
| 10,438,526 | B2 * | 10/2019 | Kim | G09G 3/2003 |
| 11,004,374 | B2 * | 5/2021 | Kurokawa | G02F 1/133 |

(Continued)

FOREIGN PATENT DOCUMENTS

| | | | |
|---|---|---|---|
| CN | 1074151 | C | 10/2001 |
| CN | 101499251 | A | 8/2009 |

(Continued)

OTHER PUBLICATIONS

Electronics-tutorial.net, Jan. 30, 2018, https://web.archive.org/web/20180130022519/https://www.electronics-tutorial.net/Digital-CMOS-Design/CMOS-Inverter/.*

*Primary Examiner* — Jose R Soto Lopez

(57) ABSTRACT

A driving device of a display panel and a display device are provided. A source driver expands display data of a low-resolution image to be displayed in a first working mode, and cooperates with the source driver to receive and processes display data of a high-resolution display image in a second working mode, which makes the driving device of the display panel has good compatibility.

16 Claims, 6 Drawing Sheets

(56) References Cited

U.S. PATENT DOCUMENTS

2006/0232541 A1 10/2006 Kudo et al.
2007/0159502 A1 7/2007 Luo
2008/0030453 A1* 2/2008 Chen ..... G09G 3/3685 345/98
2008/0143757 A1* 6/2008 Furihata ..... G09G 3/3406 345/102
2008/0284703 A1* 11/2008 Chao ..... G09G 3/3685 345/94
2008/0303750 A1* 12/2008 Ludden ..... G09G 3/2092 345/55
2008/0303767 A1* 12/2008 Ludden ..... G09G 3/3696 348/E5.074
2008/0303836 A1* 12/2008 Ludden ..... G09G 3/2092 345/531
2009/0072894 A1* 3/2009 Sugimoto ..... H03K 19/0016 327/544
2010/0164943 A1* 7/2010 Liu ..... G09G 3/3677 345/87
2011/0001463 A1* 1/2011 Jang ..... H04L 25/0264 323/311
2011/0057949 A1* 3/2011 Saitou ..... G09G 3/3688 345/596
2012/0120057 A1* 5/2012 Cho ..... H04N 13/398 345/204
2014/0210875 A1* 7/2014 Sumi ..... H04N 13/305 345/697
2016/0267716 A1* 9/2016 Patel ..... G06T 19/20
2017/0236466 A1* 8/2017 Spitzer ..... G09G 3/2085 345/560
2017/0358268 A1* 12/2017 Nishio ..... G09G 3/2011
2018/0240414 A1* 8/2018 Yang ..... G09G 3/3648
2019/0172399 A1* 6/2019 Chen ..... G09G 3/20
2019/0180702 A1* 6/2019 Kim ..... G09G 3/2003
2019/0228712 A1* 7/2019 Li ..... G09G 3/20
2020/0135081 A1* 4/2020 Duan ..... G09G 3/2096
2020/0242997 A1* 7/2020 Xue ..... G09G 3/20
2021/0319743 A1* 10/2021 Chou ..... G09G 3/2096
2021/0358359 A1* 11/2021 Yu ..... G09G 3/20
2021/0398491 A1* 12/2021 Kwak ..... G09G 3/3266

FOREIGN PATENT DOCUMENTS

CN 203895567 U 10/2014
CN 107493448 A 12/2017
CN 107610658 A 1/2018
CN 107742504 A 2/2018
CN 108630139 A 10/2018
CN 110085191 A 8/2019
CN 110214349 A 9/2019
CN 110890051 A 3/2020
GB 2207029 A 1/1989
JP H07104710 A 4/1995
WO 2007013381 A1 2/2007
WO 20000014526 A 2/2007

* cited by examiner

| | | | | | | | | | | | |
|---|---|---|---|---|---|---|---|---|---|---|---|
| before expansion | 1 | 2 | 3 | 4 | ··· | 160 | | | | | |
| after expansion | 1 | 1 | 2 | 2 | 3 | 3 | 4 | 4 | ··· | 160 | 160 |

DRIVING DEVICE OF DISPLAY PANEL AND DISPLAY DEVICE

FIELD OF INVENTION

The present application relates to a field of display technology, and particularly relates to a driving device of a display panel and a display device.

BACKGROUND OF INVENTION

Currently, for high-end liquid crystal display device products, such as high refresh rates or high-resolution products, a timing controller that can process high-resolution display data is required. However, cost of the timing controller that can process high-resolution display data is relatively high.

Therefore, it is necessary to propose a technical solution to solve a problem of excessively high cost of the timing controller of the high-end liquid crystal display device.

Technical Problem

An objective of the present application is to provide a driving device of a display panel and a display device to allow the driving device of the display device can be compatible with timing controllers that process display data with different resolutions.

SUMMARY OF INVENTION

In order to achieve the above objective, the technical solutions are as follows:

A driving device of a display panel, the driving device includes:

n source drivers, wherein n is an integer greater than or equal to 2, and each of the source drivers has a first working mode and a second working mode, each of the source drivers is configured to receive a corresponding first display data set in the first working mode and expand display data of the first display data set to obtain a second display data set, and transmit the second display data set to the display panel, display data of n first display data sets corresponding to n source drivers constitute a first image to be displayed, and a data quantity of display data in the second display data set is different from a data quantity of display data in the first display data set;

each of the source drivers is further configured to receive a corresponding third display data set in the second working mode, and transmit the third display data set to the display panel, and display data of n third display data sets corresponding to n source drivers constitute a second image to be displayed; and wherein a resolution of the second image to be displayed is greater than a resolution of the first image to be displayed.

A display device, the display device includes the above-mentioned driving device and a display panel electrically connected to the driving device.

BENEFICIAL EFFECT

The present application provides a driving device of a display panel and a display device. A source driver expands display data of a low-resolution image to be displayed in a first working mode, and cooperates with the source driver to receive and processes display data of a high-resolution display image in a second working mode to allow the driving device of the display panel can be equipped with a timing controller for processing low-resolution display data and can also be equipped with a timing controller that processes high-resolution display data. As a result, the driving device of the display panel has good compatibility.

DETAILED DESCRIPTION OF PREFERRED EMBODIMENTS

The technical solutions in the embodiments of the present application will be clearly and completely described with reference to the drawings in the embodiments of the present application. Obviously, the embodiments described are only a part of the embodiments of the present application, rather than all the embodiments. Based on these embodiments in the present application, all other embodiments obtained by those skilled in the art without doing creative work shall fall within the protection scope of the present application.

Figure 1:
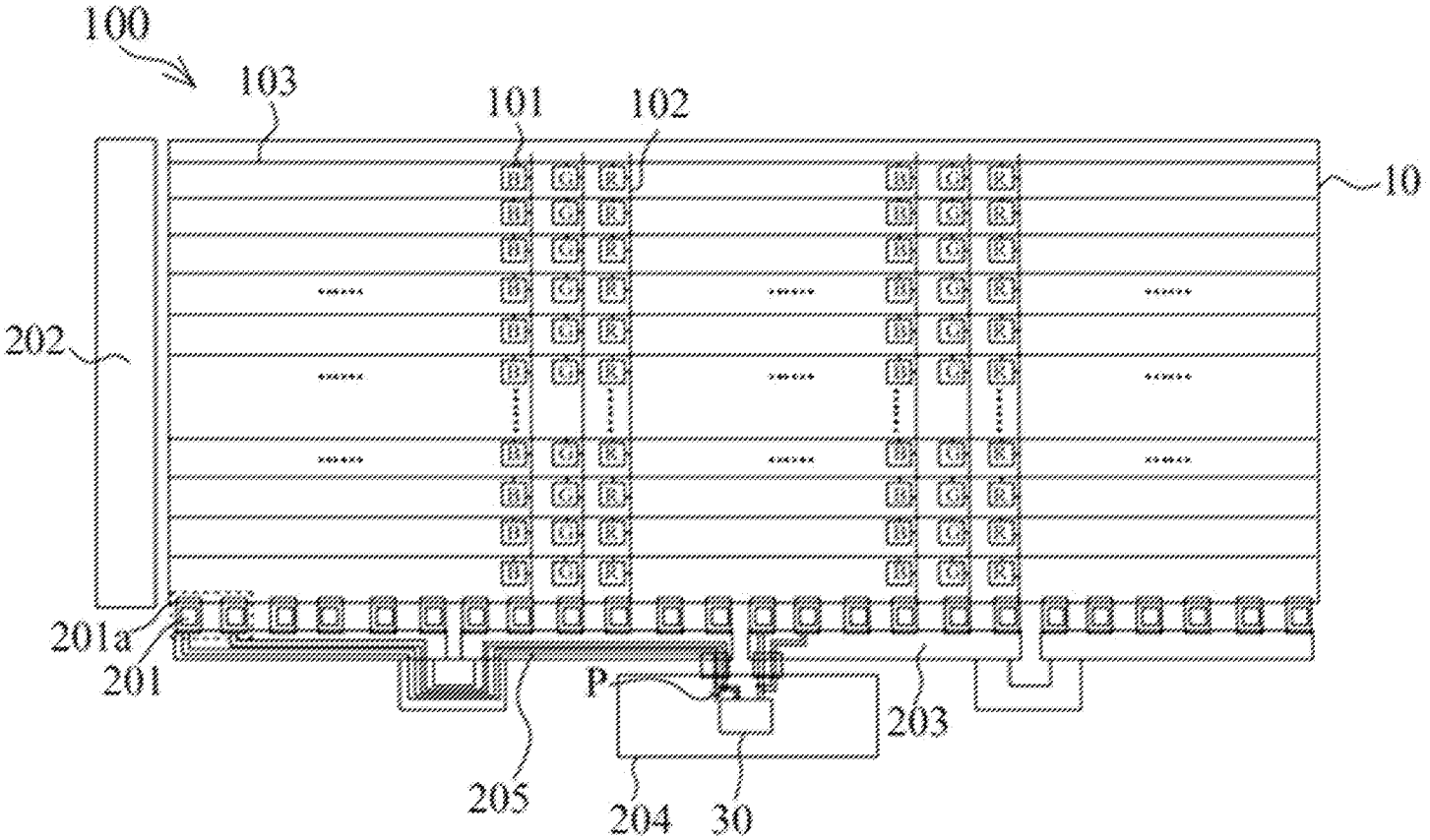
FIG. 1 is a schematic diagram of a display device in a first working mode according to an embodiment of the present application.

As shown in FIG. 1, it is a schematic diagram of a display device in a first working mode according to an embodiment of the present application. The display device 100 can be a liquid crystal display device or an organic light-emitting diode display device. The display device 100 includes a display panel 10, a driving device, and a timing controller 30. The driving device includes n source drivers 201, gate drivers 202, a plurality of transmission circuit boards 203, and transmission lines 205, where n is an integer greater than or equal to 2. The timing controller 30 is disposed on a control circuit board 204.

In this embodiment, a display panel 10 is a liquid crystal display panel. The display panel 10 includes a plurality of sub-pixels 101, a plurality of data lines 102, and 2*p* scan lines 103, where p is an integer greater than or equal to 1. The plurality of sub-pixels are arranged in an array, and each column of sub-pixels emits the same light. Each column of the plurality of sub-pixels is connected to the same data line 102, and each row of the plurality of sub-pixels is connected to the same scan line 103, that is, the display panel adopts a 1G1D architecture. The plurality of sub-pixels includes a red sub-pixel R, a blue sub-pixel B, and a green sub-pixel G. One red sub-pixel R, one blue sub-pixel B, and one green sub-pixel G constitute one pixel. Specifically, display panel 10 is an 8 k display panel, that is, the resolution of the display panel is 7680×4320.

In this embodiment, gate driver 202 is used to transmit scan signals to 2p scan lines 103. The gate driver 202 can be integrated on display panel 10, and the gate driver 202 can also be bonded on display panel 10. The gate driver 202 provides scanning signals to a plurality of adjacent scanning lines 103 at the same time so that multiple adjacent sub-pixels of the display panel 10 in the column direction input the same display data information at the same time. It provides conditions for displaying display data of low-resolution images on a high-resolution display panel.

Specifically, gate driver 202 is used to simultaneously output scan signals to 2q−1th scan line and 2qth scan line, where q is an integer greater than or equal to 1 and less than or equal to p. Therefore, the display data written in the sub-pixels in 2q−1th row and 2qth row in the same column are the same. For example, gate driver 202 provides scan signals to the first scan line and the second scan line at the same time. The gate driver 202 provides scan signals to third scan line and fourth scan line at the same time. Gate driver 202 provides scan signals to fifth scan line and sixth scan line at the same time, and so on.

In this embodiment, each source driver 201 is disposed on a flip-chip film, and a plurality of flip-chip films are bonded to one side of the display panel 10. The source drivers 201 are electrically connected to display panel 10 through a flip-chip film. Each source driver 201 includes a plurality of output channels. Each output channel is electrically connected to a data line 102 to transmit a data signal to the data line 102, and the data line 102 transmits display data to corresponding sub-pixels. It can be understood that source drivers 201 can also be directly bonded to the display panel 10.

Specifically, n is 24, that is, the driving device of this embodiment includes 24 source drivers. Each source driver includes 960 output channels, each source driver outputs 320 columns of pixel information, and each pixel information includes three sub-pixel information. The three sub-pixel information are red sub-pixel information, blue sub-pixel information, and green sub-pixel information.

In this embodiment, each source driver 201 has a first working mode and a second working mode. In the first working mode, the source driver 201 receives display data of low-resolution images and expands the display data of the low-resolution images to increase data amount of display data of the low-resolution images. Furthermore, it provides more display data for the high-resolution display panel and cooperates with gate driver 202 to provide scanning signals to multiple adjacent scanning lines at the same time, so as to provide conditions for low-resolution images to be displayed on the high-resolution display panel. In the second working mode, the source driver 201 receives display data of high-resolution images and transmits the display data of the high-resolution images to a high-resolution display panel after processing. That is, in the second working mode, the source driver is in a normal working mode. Therefore, each source driver has the ability to process low-resolution display data as well as high-resolution display data. This provides conditions for the source driver to be equipped with a timing controller that outputs low-resolution display data and a timing controller that outputs high-resolution display data. The source driver of the display device can be compatible with timing controllers with different processing capabilities, which is beneficial to reduce costs.

Figure 2:
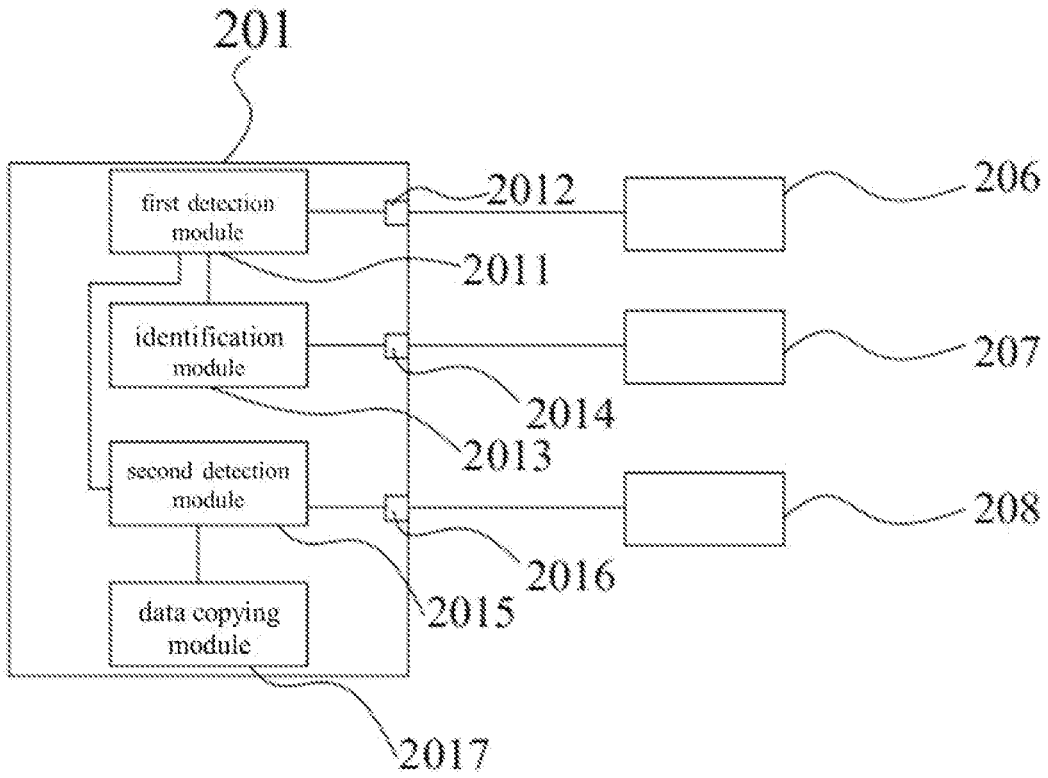
FIG. 2 is a schematic diagram of a source driver shown in FIG. 1 being electrically connected to a first output circuit, a second output circuit, and a third output circuit.

In this embodiment, as shown in FIG. 2, is a schematic diagram of a source driver shown in FIG. 1 being electrically connected to a first output circuit, a second output circuit, and a third output circuit. Each source driver 201 includes a first detection module 2011, and the first detection module 2011 is configured to detect signal input by a corresponding source driver and control the working mode of the corresponding source driver. When the first detection module detects that the corresponding source driver is input with a first preset signal, the corresponding source driver is in the first working mode, and when the first detection module 2011 detects that source driver 201 is input with a second preset signal, the source driver 201 is in the second working mode. The second preset signal is different from the first preset signal. For example, after the display device 100 is turned on, the first detection module 2011 enters a detection mode, and the working mode of the source driver 201 is adjusted according to a detection result of the first detection module 2011. Specifically, the first preset signal is a high-level signal, and the second preset signal is a low-level signal. It can be understood that the first preset signal can be a low-level signal, and the second preset signal can be a high-level signal.

Figure 3:
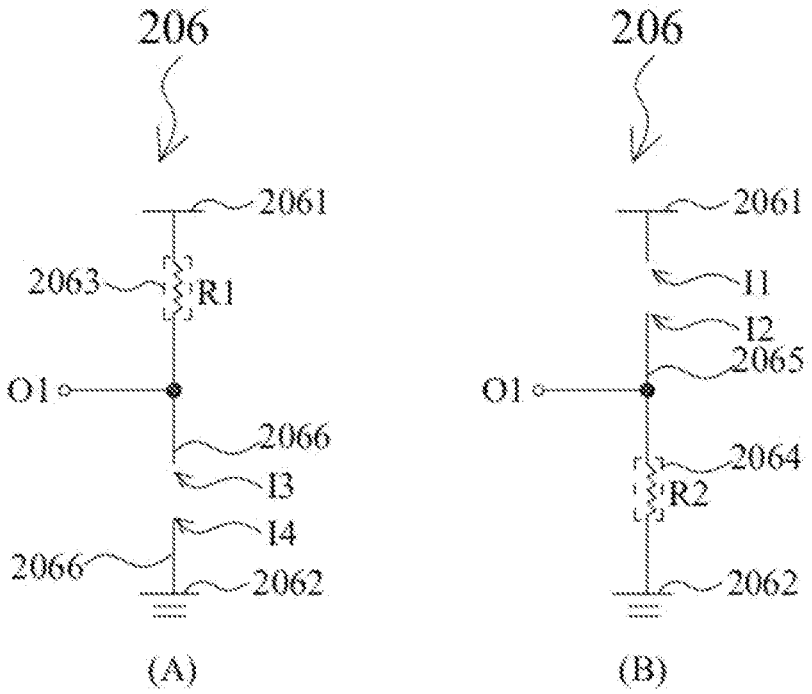
FIG. 3 is a schematic diagram of the first second output circuit shown in FIG. 2.

In this embodiment, as shown in FIG. 2 and FIG. 3. FIG. 3 is a schematic diagram of the second output circuit shown in FIG. 2. The driving device further includes n second output circuits 206, and each second output circuit 206 is electrically connected to the first detection module 2011 of the corresponding source driver 201.

Specifically, the n second output circuits 206 are electrically connected to the first detection modules 2011 of then source drivers 201 in a one-to-one manner. Each second output circuit 206 includes a third power line 2061, a fourth power line 2062, and a first output terminal O1. The third power line 2061 transmits a third electrical level, the fourth power line 2062 transmits a fourth electrical level, the first output terminal O1 is electrically connected to the first detection module 2011, and the fourth electrical level is different from the third electrical level. As shown in FIG. 3 (A). When first output terminal O1 is electrically connected to third power line 2061 and the first output terminal O1 is disconnected from fourth power line 2062, second output circuit 206 outputs the first preset signal to the first detection module 2011. Wherein, when the first output terminal O1 is electrically connected to the third power line 2061, a first voltage divider unit 2063 is connected in series between the first output terminal O1 and the third power line 2061. When the first output terminal O1 and the fourth power line 2062 are disconnected, the wire between the first output terminal O1 and the fourth power line 2062 is in a disconnection state.

As shown in FIG. 3 (B), when the first output terminal O1 is electrically connected to the fourth power line 2062 and the first output terminal O1 is disconnected from the third power line 2061, the second output circuit 206 outputs the second preset signal to the first detection module 2011. Wherein, when the first output terminal O1 is electrically connected to the fourth power line 2062, the second voltage divider unit 2064 is connected in series between the first output terminal O1 and the fourth power line 2062. When the first output terminal O1 is disconnected from the third power line 2061, the wire between the first output terminal O1 and the third power line 2061 is in a disconnection state.

Specifically, a first wire 2065 is provided between the third power line 2061 and the first output terminal O1, and the first wire 2065 has a first breakpoint I1 and a second breakpoint I2. When the first voltage divider unit 2063 is connected between first breakpoint I1 and second breakpoint I2, the third power line 2061 is electrically connected to the first output terminal O1, and the first output terminal O1 outputs the first preset signal. When the first voltage divider unit 2063 is not connected between the first breakpoint I1 and the second breakpoint I2, the third power line 2061 is disconnected from the first output terminal O1. A second wire 2066 is provided between the fourth power line 2062 and the first output terminal O1, and the second wire 2066 has a third breakpoint I3 and a fourth breakpoint I4. When second voltage divider unit 2064 is connected between the third breakpoint I3 and the fourth breakpoint I4, the fourth power line 2062 is electrically connected to the first output terminal O1, and the first output terminal O1 outputs the second preset signal. When the second voltage divider unit 2064 is not connected between the third breakpoint I3 and the fourth breakpoint I4, the fourth power line 2062 is disconnected from the first output terminal O1. The third electrical level is a high electrical level, and the fourth electrical level is a low electrical level. For example, the third electrical level is a voltage of 1.8V, and the fourth electrical level is a voltage of 0V that is grounded. The first voltage divider unit 2063 is a first resistor R1, and the second voltage divider unit 2064 is a second resistor R2. The resistance values of the first resistor R1 and the second resistor R2 may be the same or different. The first voltage divider unit 2063 can be connected between the first breakpoint I1 and the second breakpoint I2 by soldering or the like. The second voltage divider unit 2064 can also be connected between the third breakpoint I3 and the fourth breakpoint I4 by soldering or the like.

In this embodiment, as shown in FIG. 2. Each source driver 201 further includes a first pin 2012, and the first pin 2012 is electrically connected to the first output terminal O1 of the second output circuit 206. The first detection module 2011 of each source driver 201 is further electrically connected to the first pin 2012.

In this embodiment, when the display device needs to use a timing controller for processing low-resolution display data, by connecting a first resistor R1 in series on the first wire 2065 between the third power line 2061 of the first output circuit 206 and the first output terminal O1 and disconnecting the second wire 2066, so that the first output circuit 206 outputs the first selection signal to the first pin 2012. When first detection module detects first preset signal transmitted by the first pin 2012, the source driver 201 enters the first working mode. When the display device uses a timing controller for processing high-resolution display data, by connecting a second resistor R2 in series on the second wire 2066 between the fourth power line 2062 of the first output circuit 206 and the first output terminal O1 and disconnecting first wire 2065, so that the first output circuit 206 outputs second preset signal to the first pin 2012. When the first detection module detects second preset signal transmitted by the first pin 2012, the source driver 201 enters the second working mode.

Figure 4:
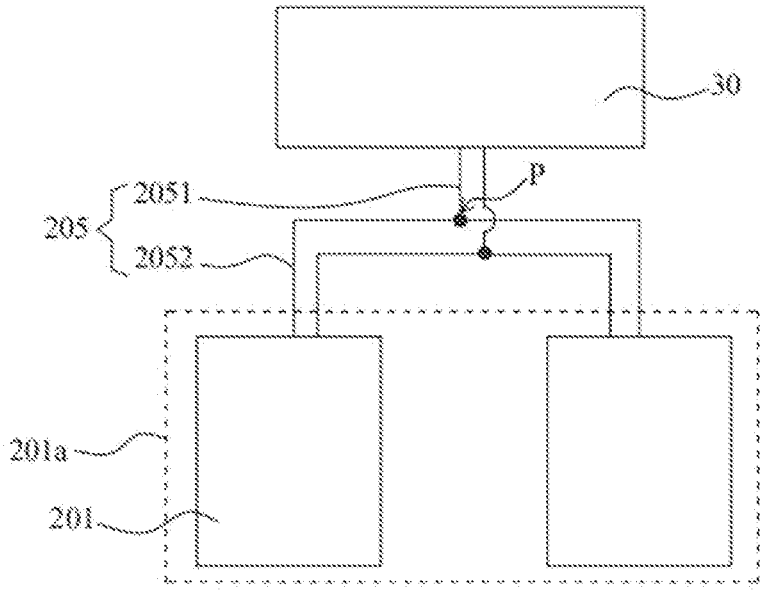
FIG. 4 is a schematic diagram of cascaded source drivers in a group of source drivers.

In this embodiment, when the n source drivers 201 are in the first working mode, the n source drivers 201 are divided into one or more groups. Each group of source drivers 201*a* includes a plurality of cascaded source drivers 201, and the number of source drivers 201 in any two groups of source drivers 201*a* is the same. As shown in FIG. 4, it is a schematic diagram of cascaded source drivers in a group of source drivers. The transmission line 205 is a point-to-point transmission line, and the transmission line 205 is connected between the timing controller 30 and the source driver 201. A pair of transmission lines 205 (two transmission lines 205) are used to transmit the same display data to a plurality of cascaded source drivers 201 in a group of source drivers 201*a*. Each transmission line 205 includes a transmission main line 2051 and a plurality of transmission branch lines 2052. One end of the transmission main line 2051 is connected to the timing controller 30, and the other end of the transmission main line 2051 is connected to one end of the multiple transmission branch lines 2052 of each transmission line 205. The other ends of the plurality of transmission branch lines 2052 of each transmission line 205 are electrically connected to the plurality of source drivers 201 of each group of source drivers 201*a* in a one-to-one manner. A pair of transmission lines is connected to a group of source drivers 201*a*, that is, each source driver 201 is connected to two transmission branch lines 2052 of a pair of transmission lines. For each transmission line 205, the connection node P between the transmission main line 2051 and the plurality of transmission branch lines 2052 is arranged on the control circuit board 204 to facilitate the adjustment of the connection relationship between the timing controller 30 and the multiple source drivers 201 when the source driver 201 switches between the first working mode and the second working mode. Specifically, each transmission line 205 includes a transmission main line 2051 and two transmission branch lines 2052. One transmission main line 2051 and two transmission branch lines 2052 are connected in a T-shape. It is understandable that the number of source drivers 201 in the at least two groups of source drivers 201*a* may also be different. The number of cascaded source drivers 201 in each group of source drivers 201*a* can also be three or more.

In this embodiment, when the n source drivers 201 are in the first working mode, the timing controller 30 receives first low-resolution image to be displayed. The timing controller 30 splits the display data of the first image to be displayed into a plurality of parallel input display data sets, each input display data set is composed of continuous multiple columns of pixel display data. Each pair of transmission lines transmits display data of one input display data set to a group of source drivers 201. Specifically, when the first image to be displayed is a 4 k image, the 4 k image includes 11520 columns of sub-pixel display data (corresponding to 3840 columns of pixel display data). The display data of the first image to be displayed is split into 12 parallel input display data sets, and each input display data set includes 960 columns of sub-pixel display data. The timing controller 30 includes 12 first interfaces. Each source driver 201 has 24 second interfaces. The transmission line is a P2P transmission line. The number of transmission lines is 12 pairs of transmission lines. Each transmission line 205 is a T-type transmission line. The first pair of T-shaped transmission lines transmit display data of the sub-pixels from 1st column to 960th column to the first group of source drivers. The second pair of T-shaped transmission lines transmit display data of the sub-pixels from 961th column to 1920th column to the second group of source drivers. The third pair of T-shaped transmission lines transmit display data of the sub-pixels from 1921th column to 2880th column to the third group of source drivers, and so on.

In this embodiment, as shown in FIG. 2, each source driver 201 further includes an identification module 2013. When the source driver 201 is in the first working mode, the identification module 2013 is activated and identifies the identification signal corresponding to the source driver 201 to obtain an identification result. Part of display data in the input display data set received by each source driver 201 according to the identification result and preset rule is a corresponding display data of the first display data set, and display data of the first display data set received by the plurality of source drivers 201 arranged in cascade in each group of source drivers 201*a* collectively constitute the input display data set.

Figure 5:
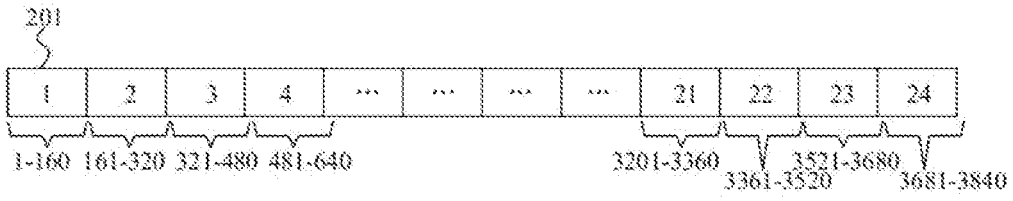
FIG. 5 is a schematic diagram of a plurality of source drivers receiving corresponding first display data sets.

Specifically, each group of source drivers 201*a* includes a cascaded first source driver and a second source driver, and the identification signal includes a first identification signal and a second identification signal. Each input display data set consists of continuous display data of i columns of pixels, i is an integer greater than or equal to 2. The preset rule is: One of the first source driver and the second source driver receives first identification signal and display data of consecutive first i/2 columns of pixels, another one of the first source driver and the second source driver receives second identification signal and display data of consecutive last i/2 columns of pixels. For example, as shown in FIG. 5. Two cascaded source drivers 201 are used as a set of source drivers, and each input display data set is composed of display data of 960 columns of sub-pixels (corresponding to 320 columns of pixel display data). After the first source driver receives a first identification signal, the first source driver receives display data of the first 480 columns of consecutive sub-pixels (corresponding to display data of the first 160 columns of pixels, each column of pixels includes three columns of sub-pixels). After the second source driver receives second identification signal, the second source driver receives display data of the last 480 columns of consecutive sub-pixels (corresponding to display data of the last 160 columns pixels). Therefore, the first source driver 201 receives display data of pixels from 1-160th columns to form a first display data set, the second source driver 201 receives display data of pixels from 161-320th columns to form the first display data set, the third source driver receives display data of pixels from 321-480th columns to form the first display data set, and the fourth source driver receives display data of pixels from 481-640th columns to form the first display data set.

It should be noted that each source driver 201 is provided with a selector, and when the transmission line transmits display data of the input display data set to the source driver 201. The selector will select part of the display data in the input display data set as valid data, and the valid data is the display data in the first display data set received by each source driver 201. The selector is a module in the current source driver and will not be described in detail herein.

Figure 6:
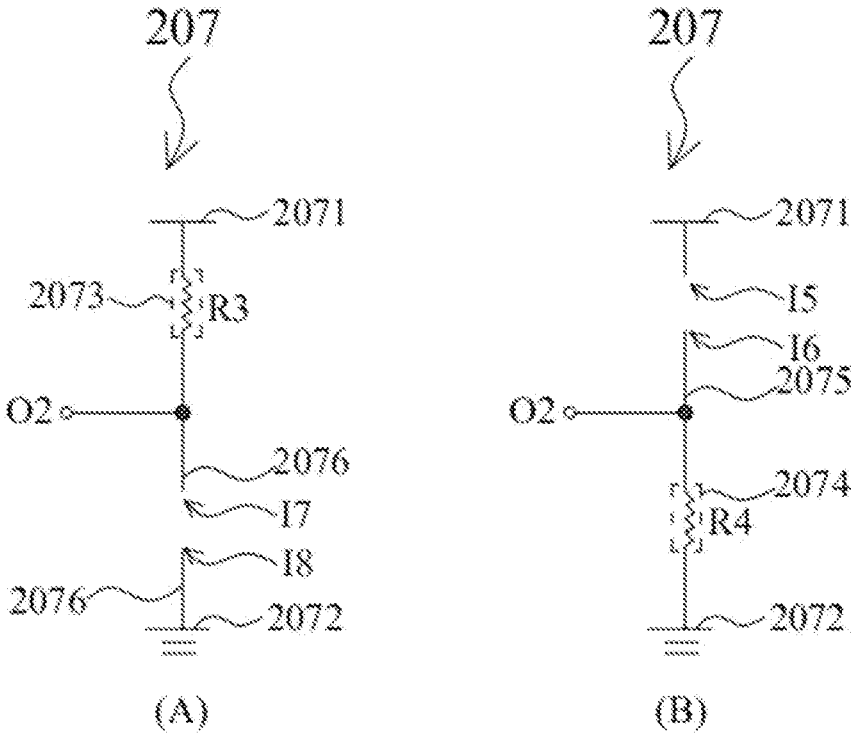
FIG. 6 is a schematic diagram of the first output circuit shown in FIG. 2.

In this embodiment, as shown in FIG. 6, is a schematic diagram of the first output circuit shown in FIG. 2. The driving device further includes n second first output circuits 207, and each first output circuit 207 is electrically connected to the identification module 2013 of a corresponding source driver 201. Specifically, the n first output circuits 207 are electrically connected to the identification modules 2013 of the n source drivers 201 in a one-to-one manner. Each first output circuit 207 includes a first power line 2071, a fourth second power line 2072, and a second output terminal O2. The first power line 2071 transmits first electrical level, the fourth second power line 2072 transmits fourth electrical level, and the second output terminal O2 is electrically connected to the identification module 2013. The second output terminal O2 is electrically connected to the first power line 2071 or the fourth second power line 2072, where the first electrical level is different from the fourth electrical level. Each first output circuit 207 includes a first power line 2071, a fourth second power line 2072, and a second output terminal O2. The first power line 2071 transmits first electrical level, the fourth second power line 2072 transmits fourth electrical level, and the second output terminal O2 is electrically connected to the identification module 2013. The second output terminal O2 is electrically connected to the first power line 2071 or the fourth second power line 2072, where the first electrical level is different from the fourth electrical level. As shown in FIG. 6 (A), when the second output terminal O2 is electrically connected to the first power line 2071 and the second output terminal O2 is disconnected from the fourth second power line 2072, the first output circuit 207 outputs first identification signal to identification module 2013. Wherein, when the second output terminal O2 is electrically connected to the first power line 2071, the third voltage divider unit 2073 is connected in series between the second output terminal O2 and the first power line 2071. When the second output terminal O2 is disconnected from the fourth second power line 2072, the wire between the second output terminal O2 and the fourth second power line 2072 is in a disconnection state. As shown in FIG. 6(B), when the second output terminal O2 is electrically connected to the fourth second power line 2072 and the second output terminal O2 is disconnected from the first power line 2071, the first output circuit 207 outputs second identification signal to the identification module 2013. Wherein, when the second output terminal O2 is electrically connected to fourth second power line 2072, a fourth voltage divider unit 2074 is provided between the second output terminal O2 and the fourth second power line 2072. When the second output terminal O2 is disconnected from the first power line 2071, the wire between the second output terminal O2 and the first power line 2071 is in a disconnection state.

Specifically, a third wire 2075 is provided between the first power line 2071 and the second output terminal O2, and the third wire 2075 has a fifth breakpoint I5 and a sixth breakpoint I6. When the third voltage divider unit 2073 is connected between the fifth breakpoint I5 and the sixth breakpoint I6, the first power line 2071 is electrically connected to the second output terminal O2, and the second output terminal O2 outputs first identification signal. When the third voltage divider unit 2073 is not connected between the fifth breakpoint I5 and the sixth breakpoint I6, the first power line 2071 is disconnected from the second output terminal O2. A fourth wire 2076 is provided between the fourth second power line 2072 and the second output terminal O2, and the fourth wire 2076 has a seventh breakpoint I7 and an eighth breakpoint I8. When the fourth voltage divider unit 2074 is connected between the seventh breakpoint I7 and the eighth breakpoint I8, the fourth second power line 2072 is electrically connected to the second output terminal O2, and the second output terminal O2 outputs second identification signal. When the fourth voltage divider unit 2074 is not connected between the seventh breakpoint I7 and the eighth breakpoint I8, the fourth second power line 2072 is disconnected from the second output terminal O2. The third electric level is a high electric level, and the fourth electric level is a low electric level. For example, the third electric level is a voltage of 1.8V, that is, the third electric level is the same as the third electrical level. The second electric level is a grounded 0V voltage, that is, the fourth electric level is the same as the second electric level. The third voltage divider unit 2073 is a third resistor R3, and the fourth voltage divider unit 2074 is a fourth resistor R4. The resistance values of the third resistor R3 and the fourth resistor R4 can be the same or different. The third voltage divider unit 2073 can be connected between the fifth breakpoint I5 and the sixth breakpoint I6 by soldering or the like. The fourth voltage divider unit 2074 can also be connected between the seventh breakpoint I7 and the eighth breakpoint I8 by soldering or the like.

In this embodiment, as shown in FIG. 2, each source driver 201 further includes a second pin 2014. The second pin 2014 is electrically connected to the second output terminal O2 of the first output circuit 207. The identification module 2013 of each source driver 201 is also electrically connected to the second pin 2014.

In this embodiment, by setting the first output circuit 207 electrically connected to each source driver 201 to control the identification signal received by each source driver 201 and cooperating with the preset rule to control the effective display data received by each source driver 201. The effective display data is the basis for the source driver 201 to expand display data.

In this embodiment, as shown in FIG. 2, each source driver 201 further includes a data copying module 2017. The data copying module 2017 is configured to copy display data in the first display data set to obtain display data of the second display data set.

Figures 7, 8:
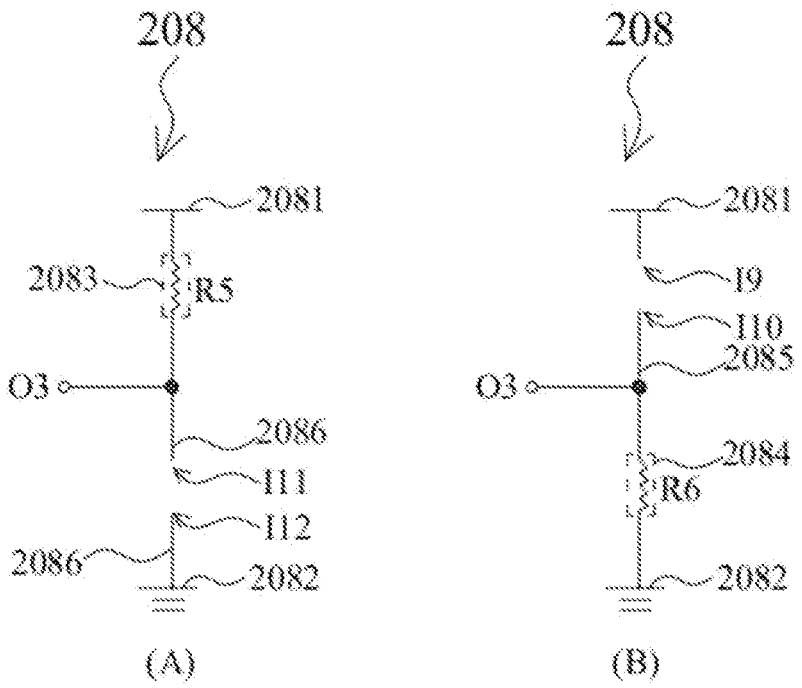
FIG. 7 is a schematic diagram of a plurality of source drivers expanding display data in a first display data set to form a second display data set.
FIG. 8 is a schematic diagram of the third output circuit shown in FIG. 2.

Specifically, as shown in FIG. 7, before expansion, the first display data set contains display data of pixels from first to 160th columns. After expansion, the display data in the first display data set is copied once to obtain the second display data set. In the second display data set, the display data of the two groups of pixels are the same. The data quantity of the display data in the second display data set is twice the data quantity of the display data in the first display data set.

Figure 9:
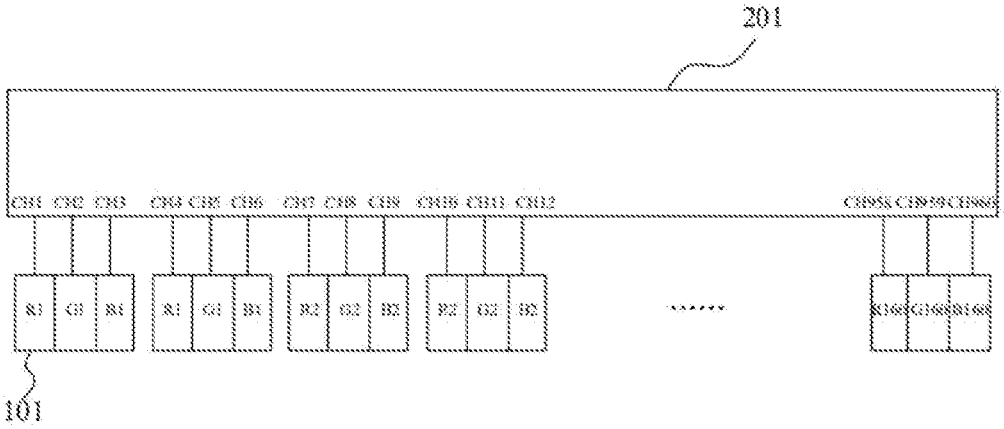
FIG. 9 is a schematic diagram of a source driver outputting display data of a second display data set.

In this embodiment, when the source driver 201 is in the first working mode, the source driver 201 maps the display data in the second display data set to the corresponding output channel and outputs the display data to the data line on the display panel 10 through the output channel. Specifically, as shown in FIG. 9, each source driver includes 6m output channels, where m is greater than or equal to 1. 6 adjacent output channels form a group, the 6 output channels are composed of the 6m output channel, the 6m−1 output channel, the 6m−2 output channel, the 6m−3 output channel, the 6m−4 output channel, and the 6m−5 output channel. A set of output channels output corresponding display data to two adjacent pixels (6 sub-pixels 101) on the display panel 10. Wherein, the display data of the sub-pixels output by the 6m output channel and the 6m−3 output channel (for example, output channel CH6 and output channel CH3) are the same. The display data of the sub-pixels output by the 6m−1 output channel and the 6m−4 output channel (for example, output channel CH5 and output channel CH2) are the same. The display data of the sub-pixels output by the 6m−2 output channel and the 6m−5 output channel (for example, output channel CH4 and output channel CH1) are the same.

In this embodiment, in the first working mode, each source driver 201 is configured to receive a corresponding first display data set, expand the display data in the first display data set to obtain a second display data set, map the display data of the second display data set to the corresponding output channel, and transmit it to the display panel 10. The display data of then first display data sets corresponding to the n source drivers 201 constitute the first image to be displayed. The data quantity of the display data in the second display data set is different from the data quantity of the display data in the first display data set. When the source driver 201 is in the first working mode, the data quantity of the display data is increased by copying the display data.

In this embodiment, as shown in FIG. 2, each source driver 201 further includes a second detection module configured to be activated in the first working mode 2015. When the source driver 201 is input with a third preset signal, the second detection module is configured to control the data copying module 2017 to turn on. When the source driver 201 is input with a fourth preset signal, the second detection module is further configured to control the data copying module 2017 to turn off.

In this embodiment, as shown in FIG. 8, the driving device further includes n third output circuits 208, and each third output circuit 208 is electrically connected to the second detection module 2015 of the corresponding source driver 201. Specifically, the n third output circuits 208 are electrically connected to the second detection modules 2015 of the n source drivers 201 in a one-to-one manner. The third output circuit 208 includes a fifth power line 2081, a sixth power line 2082, and a third output terminal O3. The fifth power line 2081 transmits a fifth electric level, the sixth power line 2082 transmits a sixth electric level, and the sixth electric level is different from the fifth electric level. The third output terminal O3 is electrically connected to the second detection module 2015. As shown in FIG. 8 (A), when the third output terminal O3 is electrically connected to the fifth power line 2081 and the third output terminal O3 is disconnected from the sixth power line 2082, the third output circuit 208 outputs third preset signal to the second detection module 2015. As shown in FIG. 8 (B), when the third output terminal O3 is electrically connected to sixth power line 2082 and the third output terminal O3 is disconnected from the fifth power line 2081, the third output circuit 208 outputs fourth preset signal to the second detection module 2015.

Specifically, a fifth wire 2085 is provided between the fifth power line 2081 and the third output terminal O3, and the fifth wire 2085 has a ninth breakpoint I9 and a tenth breakpoint I10. When a fifth voltage divider unit 2083 is connected between the ninth breakpoint I9 and the tenth breakpoint I10, the fifth power line 2081 is electrically connected to the third output terminal O3, and the third output terminal O3 outputs third preset signal. After receiving the third preset signal, the second detecting module 2015 controls the data copying module 2017 to be turned on to copy the display data. When a sixth voltage divider unit 2084 is not connected between the eleventh breakpoint I11 and the twelfth breakpoint I12, the sixth power line 2082 is disconnected from the third output terminal O3. A sixth wire 2086 is provided between the sixth power line 2082 and the third output terminal O3, and the sixth wire 2086 has an eleventh breakpoint I11 and a twelfth breakpoint I12. When the sixth voltage divider unit 2084 is connected between the eleventh breakpoint I11 and the twelfth breakpoint I12, the sixth power line 2082 is electrically connected to the third output terminal O3, and the third output terminal O3 outputs the fourth preset signal. When the fifth voltage divider unit 2083 is not connected between the ninth breakpoint I9 and the tenth breakpoint I10, the fifth power line 2081 and the third output terminal O3 are disconnected. The fifth electric level is a high electric level, and the sixth electric level is a low electric level. For example, the fifth electric level is a voltage of 1.8V, that is, the fifth electric level is the same as the third electrical level. The sixth electric level is a grounded 0V voltage, that is, the sixth electric level is the same as the second electric level. The fifth voltage divider unit 2083 is a fifth resistor R5, and the sixth voltage divider unit 2084 is a sixth resistor R6. The resistance values of the fifth resistor R5 and the sixth resistor R6 can be the same or different. The fifth voltage divider unit 2083 can be connected between the ninth breakpoint I9 and the tenth breakpoint I10 by soldering or the like. The sixth voltage divider unit 2084 can also be connected between the eleventh breakpoint I11 and the twelfth breakpoint I12 by soldering or the like.

In this embodiment, as shown in FIG. 2, each source driver 201 further includes a third pin 2016. The third pin 2016 is electrically connected to the third output terminal O3 of the third output circuit 208, and the second detection module 2015 of each source driver 201 is also electrically connected to the third pin 2016.

In this embodiment, when the source driver 201 is in the first working mode, the third output circuit 208 is adjusted to output the third preset signal, such that the data copying module 2017 of the source driver 201 is turned on. When the source driver is in the second working mode, the third output circuit 208 is adjusted to output the fourth preset signal, such that the data copying module 2017 of the source driver 201 is turned off.

In this embodiment, the transmission circuit board 203 is served as a carrier substrate, and each transmission circuit board 203 is connected between the flip-chip film carrying a plurality of source drivers 201 and the timing controller 30. The n second output circuits 206, n first output circuits 207, and n third output circuits 208 are all arranged on the transmission circuit board 203. Each second output circuit 206 is configured corresponding to one source driver 201. Specifically, each transmission circuit board 203 is connected to six flip-chip films carrying source drivers 201.

Figure 10:
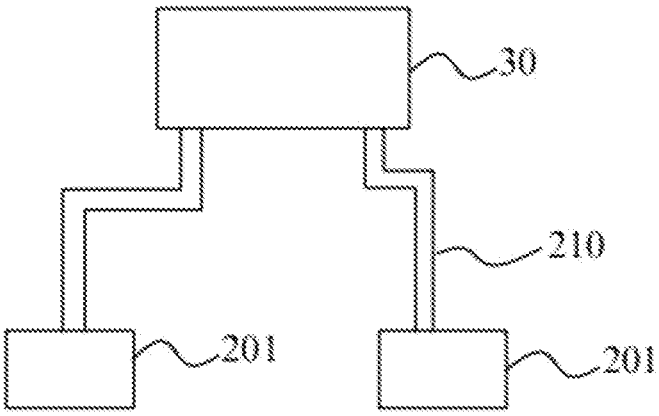
FIG. 10 is a partial schematic diagram of a display device in a second working mode according to an embodiment of the present application.

In this embodiment, each source driver 201 is further configured to receive the corresponding third display data set in the second working mode, and transmit the third display data set to the display panel 10. The display data of n third display data sets corresponding to n source drivers 201 constitute a second image to be displayed, wherein a resolution of the second image to be displayed is greater than a resolution of the first image to be displayed. As shown in FIG. 10, in the second working mode, each source driver 201 and the timing controller 30 transmit signals through a pair of P2P (point-to-point) transmission lines 210. In this situation, the working mode of the source driver 201 is the same as the working mode of the source driver of the prior art, and will not be described in detail herein.

In this embodiment, the resolution of the second image to be displayed is equal to the resolution of the display panel 10, and the resolution of the second image to be displayed is twice the resolution of the first image to be displayed. For example, the second image to be displayed is an 8 k image, and the first image to be displayed is a 4 k image.

The source driver of the display device of this embodiment can be used with a timing controller that processes high-resolution display data, or it can be used with a timing controller that processes low-resolution display data, so as to increase the compatibility of the source driver. The source driver is equipped with a timing controller for processing low-resolution images, and when low-resolution images are displayed on a high-resolution display panel, a display effect of the display panel is between a display effect of a low-resolution display panel displaying low-resolution images and a display effect of a high-resolution display panel displaying high-resolution images. Compared with the prior art, while the display effect of the display device is improved, the cost of the display device is reduced.

The descriptions of the embodiments are only used to help understand the technical solutions and core ideas of the present application. Those of ordinary skill in the art should understand that they can modify the technical solutions described in the foregoing embodiments, or equivalently replace some of the technical features. However, these modifications or replacements do not cause the essence of the technical solutions to deviate from the scope of the technical solutions of the embodiments of the present application.

What is claimed is:

1. A driving device of a display panel, comprising:

source drivers arranged in at least one group, wherein the source drivers in each group comprise a first source driver and a second source driver arranged in cascade and collectively receive an input display data set, wherein each of the source drivers has a first working mode and a second working mode and comprises an identification module configured to be activated in the first working mode and identify an identification signal received by a respective source driver to obtain an identification result, wherein the identification signal comprises a first identification signal and a second identification signal, and the input display data set is composed of consecutive display data of i columns of pixels, and wherein i is an integer greater than or equal to 2; and first output circuits, wherein each first output circuit is electrically connected to the identification module of a corresponding source driver and comprises a first power line configured to transmit first electrical level, a second power line configured to transmit second electrical level different from the first electrical level, and a second output terminal electrically connected to the first power line or the second power line and the identification module, and wherein when the second output terminal is electrically connected to the first power line and disconnected from the second power line, the first output circuit outputs the first identification signal to the identification module, and when the second output terminal is electrically connected to the second power line and disconnected from the first power line, the first output circuit outputs the second identification signal to the identification module;

wherein each of the source drivers is configured to receive a corresponding first display data set in the first working mode, expand display data of the first display data set to obtain a second display data set, and transmit the second display data set to the display panel, wherein display data of the first display data sets corresponding to the source drivers constitute a first image to be displayed, and a data quantity of display data in the second display data set is different from a data quantity of display data in the first display data set, wherein part of display data in the input display data set received by the source drivers in each group according to the identification result and a preset rule is a corresponding display data of the first display data set, and display data of the first display data set received by the source drivers arranged in cascade in each group constitute a corresponding input display data set, and wherein the preset rule is: one of the first source driver or the second source driver receives the first identification signal and display data of first consecutive i/2 columns of pixels, another one of the first source driver or the second source driver receives the second identification signal and display data of last consecutive i/2 columns of pixels, and the display data of the first consecutive i/2 columns of pixels and the display data of the last consecutive i/2 columns of pixels constitute display data of the i columns of pixels;

wherein each of the source drivers is further configured to receive a corresponding third display data set in the second working mode and transmit the third display data set to the display panel, and display data of the third display data sets corresponding to the source drivers constitute a second image to be displayed; and wherein a resolution of the second image to be displayed is greater than a resolution of the first image to be displayed.

2. The driving device of the display panel of claim 1, wherein each of the source drivers further comprises a first detection module configured to detect a signal input to a corresponding source driver and control a working mode of the corresponding source driver;

when the first detection module detects that the corresponding source driver is input with a first preset signal, the corresponding source driver is in the first working mode; and when the first detection module detects that the corresponding source driver is input with a second preset signal, the corresponding source driver is in the second working mode, wherein the second preset signal is different from the first preset signal.

3. The driving device of the display panel of claim 2, further comprising second output circuits, wherein each of the second output circuits is electrically connected to the first detection module of a corresponding source driver and comprises:

a third power line configured to transmit third electrical level;

a fourth power line configured to transmit fourth electrical level, wherein the third electrical level is different from the fourth electrical level; and a first output terminal electrically connected to the third power line or the fourth power line and the first detection module;

wherein when the first output terminal is electrically connected to the third power line and the first output terminal is disconnected from the fourth power line, each of the second output circuits outputs the first preset signal to the first detection module; and when the first output terminal is electrically connected to the fourth power line and the first output terminal is disconnected from the third power line, each of the second output circuits outputs the second preset signal to the first detection module.

4. The driving device of the display panel of claim 3, wherein when the first output terminal is electrically connected to the third power line, a first voltage divider unit is connected in series between the first output terminal and the third power line, and when the first output terminal is electrically connected to the fourth power line, a second voltage divider unit is connected in series between the first output terminal and the fourth power line.

5. The driving device of the display panel of claim 1, further comprising a transmission line, wherein when the source drivers are in the first working mode, the transmission line is configured to transmit corresponding display data of the input display data set to the plurality of source drivers in each group, and wherein the transmission line comprises:

a transmission main line; and a plurality of transmission branch lines connected with the transmission main line, wherein the plurality of transmission branch lines are electrically connected to the plurality of source drivers in each group in one-to-one correspondence.

6. The driving device of the display panel of claim 1, wherein each of the source drivers further comprises a data copying module configured to copy display data of the first display data set to obtain display data of the second display data set.

7. The driving device of the display panel of claim 6, wherein each of the source drivers further comprises a second detection module configured to be activated in the first working mode; and when each of the source drivers is input with a third preset signal, the second detection module is configured to control the data copying module to turn on.

8. The driving device of the display panel of claim 7, wherein when each of the source drivers is input with a fourth preset signal, the second detection module is further configured to control the data copying module to turn off.

9. The driving device of the display panel of claim 8, further comprising third output circuits, wherein each of the third output circuits is electrically connected to the second detection module of a corresponding source driver, and the third output circuits comprise:

a fifth power line configured to transmit fifth electrical level;

a sixth power line configured to transmit sixth electrical level, wherein the sixth electrical level is different from the fifth electrical level; and a third output terminal electrically connected to the fifth power line or the sixth power line, and is electrically connected to the second detection module;

when the third output terminal is electrically connected to the fifth power line and disconnected from the sixth power line, the third output circuits output the third preset signal to the second detection module; and when the third output terminal is electrically connected to the sixth power line and disconnected from the fifth power line, the third output circuits output the fourth preset signal to the second detection module.

10. The driving device of the display panel of claim 9, further comprising:

flip-chip films, wherein each of the source drivers is disposed on one of the flip-chip films; and a transmission circuit board connected to the flip-chip films, wherein the third output circuits are disposed on the transmission circuit board.

11. The driving device of the display panel of claim 1, wherein the resolution of the second image to be displayed is equal to a resolution of the display panel, and the resolution of the second image to be displayed is twice the resolution of the first image to be displayed.

12. The driving device of the display panel of claim 1, wherein the display panel further comprises scan lines, wherein quantity of the scan lines is defined as 2p, and the driving device further comprises:

a gate driving circuit configured to simultaneously output scan signals to a (2q−1)th scan line and a (2q)th scan line, wherein p is an integer greater than or equal to 1, and q is an integer greater than or equal to 1 and less than or equal to p.

13. A display device, comprising the driving device of the display panel of claim 1.

14. The display device of claim 13, wherein each of the source drivers further comprises a first detection module configured to detect a signal input to a corresponding source driver and control a working mode of the corresponding source driver;

when the first detection module detects that the corresponding source driver is input with a first preset signal, the corresponding source driver is in the first working mode; and when the first detection module detects that the corresponding source driver is input with a second preset signal, the corresponding source driver is in the second working mode, wherein the second preset signal is different from the first preset signal.

15. The display device of claim 14, further comprising second output circuits, wherein each of the second output circuits is electrically connected to the first detection module of a corresponding source driver and comprises:

a third power line configured to transmit third electrical level;

a fourth power line configured to transmit fourth electrical level, wherein the third electrical level is different from the fourth electrical level; and a first output terminal electrically connected to the third power line or the fourth power line and electrically connected to the first detection module;

wherein when the first output terminal is electrically connected to the third power line and the first output terminal is disconnected from the fourth power line, each of the plurality of first second output circuits outputs the first preset signal to the first detection module; and when the first output terminal is electrically connected to the fourth power line and the first output terminal is disconnected from the third power line, each of the plurality of first second output circuits outputs the second preset signal to the first detection module.

16. The display device of claim 13, wherein each of the source drivers further comprises a data copying module configured to copy display data of the first display data set to obtain display data of the second display data set.

* * * * *